US011158984B2

(12) United States Patent
Graßl et al.

(10) Patent No.: US 11,158,984 B2
(45) Date of Patent: Oct. 26, 2021

(54) RF CONNECTOR WITH LOW PASSIVE INTERMODULATION

(71) Applicant: SPINNER GmbH, München (DE)

(72) Inventors: Martin Graßl, Erding (DE); Torsten Smyk, Westerham (DE)

(73) Assignee: SPINNER GMBH

( * ) Notice: Subject to any disclaimer, the term of this patent is extended or adjusted under 35 U.S.C. 154(b) by 0 days.

(21) Appl. No.: 16/265,418

(22) Filed: Feb. 1, 2019

(65) Prior Publication Data

US 2019/0165524 A1 May 30, 2019

Related U.S. Application Data

(63) Continuation of application No. PCT/EP2017/069641, filed on Aug. 3, 2017.

(30) Foreign Application Priority Data

Aug. 4, 2016 (EP) ..... 16182830.6

(51) Int. Cl.

| | |
|---|---|
| ***H01R 24/52*** | (2011.01) |
| ***H01R 24/44*** | (2011.01) |
| ***H01R 13/11*** | (2006.01) |
| ***H01R 13/631*** | (2006.01) |
| *H01R 103/00* | (2006.01) |

(52) U.S. Cl.

CPC ..... *H01R 24/52* (2013.01); *H01R 13/111* (2013.01); *H01R 13/631* (2013.01); *H01R 24/44* (2013.01); *H01R 2103/00* (2013.01)

(58) Field of Classification Search

CPC .. H01R 24/452; H01R 13/111; H01R 13/631; H01R 24/44

USPC ..... 439/374

See application file for complete search history.

(56) References Cited

U.S. PATENT DOCUMENTS 5,074,809 A * 12/1991 Rousseau ..... H01R 24/44 439/578
6,024,609 A * 2/2000 Kooiman ..... H01R 24/40 411/433
6,174,206 B1 * 1/2001 Yentile ..... H01R 24/542 439/578

(Continued)

FOREIGN PATENT DOCUMENTS

CA 2432051 A1 11/2004
CN 202888365 U 4/2013

(Continued)

OTHER PUBLICATIONS

China National Intellectual Property Administration, English Translation of Second Office Action for application 201780048624-2. dated May 26, 2020.

*Primary Examiner* — Alexander Gilman

(74) *Attorney, Agent, or Firm* — Yakov Sidorin; Quarles & Brady LLP

(57) ABSTRACT

A coaxial connector includes a center conductor and an outer conductor coaxial with the center conductor. The outer conductor has a cylindrical shape with slits forming a plurality of spring loaded contact elements. The connector further has a base for mounting the coaxial connector and an outer housing. To improve passive intermodulation characteristics, the base, the slotted outer conductor and the outer housing are monolithically made in one piece.

6 Claims, 5 Drawing Sheets

(56) References Cited

U.S. PATENT DOCUMENTS

| | | | | |
|---|---|---|---|---|
| 6,267,621 | B1 * | 7/2001 | Pitschi | H01R 24/564 439/578 |
| 7,294,023 | B2 * | 11/2007 | Schneider | H01P 1/045 439/675 |
| 7,495,527 | B2 * | 2/2009 | Ornt | H01P 1/125 333/105 |
| 8,323,054 | B2 * | 12/2012 | Igarashi | H01R 24/54 439/578 |
| 9,147,955 | B2 * | 9/2015 | Hanson | H01R 13/2421 |
| 9,236,694 | B2 * | 1/2016 | Binder | H01R 13/629 |
| 9,548,572 | B2 * | 1/2017 | Burris | H01R 9/0521 |
| 10,027,053 | B2 * | 7/2018 | Antonini | H01R 24/38 |
| 10,148,047 | B2 * | 12/2018 | Wimmer | H01R 13/5219 |
| 2008/0254668 | A1 * | 10/2008 | Rosenberger | H01R 13/14 439/335 |
| 2009/0280682 | A1 * | 11/2009 | Zhang | H01R 9/05 439/578 |
| 2011/0130048 | A1 * | 6/2011 | Haunberger | H01R 24/40 439/660 |

FOREIGN PATENT DOCUMENTS

| | | | |
|---|---|---|---|
| CN | 204349085 | U | 5/2015 |
| CN | 104798265 | A | 7/2015 |
| CN | 104823339 | A | 8/2015 |
| CN | 205016784 | U | 2/2016 |
| DE | 1813161 | U | 6/1960 |
| DE | 8424348 | U1 | 11/1984 |
| EP | 2615699 | A1 | 7/2013 |
| JP | 2010257678 | A | 11/2010 |
| KR | 1020010013364 | A | 2/2001 |
| KR | 1020140062072 | A | 5/2014 |
| WO | 2015192382 | A1 | 12/2015 |

* cited by examiner

RF CONNECTOR WITH LOW PASSIVE INTERMODULATION

CROSS-REFERENCE TO RELATED APPLICATIONS

This application is a continuation of the pending International Application No. PCT/EP2017/069641 filed on Aug. 3, 2017, which designates the United States and claims priority from the European Application No. 16182830.6 filed on Aug. 4, 2016. The disclosure of each of the above-mentioned applications is incorporated herein by reference.

BACKGROUND

1. Field of the Invention

The invention relates generally to a coaxial connector for use with signals in radio frequency (RF) spectral range and, in particular, to a coaxial connect employing a socket part that has a low passive intermodulation (PIM) outer conductor and may be mated with a plug part of the connector.

2. Description of Relevant Art

U.S. Pat. No. 9,236,694 B2 discloses a coaxial connector system designed for low passive intermodulation. A plug connector has a spring-loaded outer connector for contacting the solid side wall of a socket connector. Due to a precision contact design and high contacting forces between the plug connector and the second connector, a low passive intermodulation is achieved.

SUMMARY

The embodiments provide a RF socket connector having a spring-loaded outer conductor while improving passive intermodulation characteristics of the connector.

In an embodiment, a coaxial plug connector and a coaxial socket connector each have a housing, a center conductor and an outer conductor. The center conductors define by their centers a center axis of the connectors. The outer conductors are arranged coaxially around the center conductors and hold the center conductors by insulators. The housing may be a part of the outer conductor.

Herein, for simplicity it is distinguished between a plug connector and a socket connector. This naming has no influence on the embodiments as long as the essential features are provided.

A coaxial plug connector has an outer conductor, which fits, into a socket of the socket connector. A center conductor at the plug connector contacts and preferably fits into a center conductor of the socket connector. There is preferably at least one means for mechanically fastening the plug connector to the socket connector.

According to a first embodiment, the coaxial socket connector has an outer conductor with a plurality of parallel slits extending from the plug connector facing side and dividing the outer conductor into a plurality of spring loaded contact elements. These spring-loaded contact elements fit into the inner contour of the coaxial plug connector, which preferably includes cylindrical and conical sections. Preferably, the spring-loaded contact elements are oriented such, that they apply force in radial direction outwards of the center when mated.

The coaxial socket connector has a base which may be used for mounting the connector for example to a housing or a chassis, and which preferably forms the ground connection of the connector. The base may be mounted to any device like a metal plate, a housing or similar. Preferably, the base includes a flange, most preferably a rectangular flange. The flange may be held by at least one screw.

Alternatively, the base may include a bearing surface. The outer housing may include an outer thread configured to hold a nut which may be tightened to hold any device like a metal plate, a housing or similar between the bearing surface and the nut. There may be a sealing close to the bearing surface.

The base may also have a cylindrical shape, preferably having a thread, such that it may be held in a hole and locked by a nut.

The outer conductor/outer housing comprising a plurality of spring loaded contact elements is one part with the base. Here, the spring loaded contact elements are not pressed forming a press fit nor soldered nor welded into the base. Due to this monolithic embodiment, there is no electrical connection in the current path of the outer conductor between two parts, which may have a thin oxide layer generating PIM. Therefore, PIM is further minimized.

The connector may have a mechanical contact surface at a right angle to the center axis and distant from the spring loaded contact elements.

An outer housing may be provided at the base forming one part with the base.

It is further preferred, if an outer housing of the coaxial socket connector is also one part with the base. The outer housing may further include a mechanical reference plane and/or centering means. It may also include locking means for a plug connector like a thread, preferably an outer thread, a protrusion or bayonet components.

In another preferred embodiment, the outer housing of the coaxial socket connector is screwed, soldered or welded to the base. It may have a thread fitting to a thread at the base and/or the spring loaded contact elements. The outer housing may further include a mechanical reference plane and/or centering means. It may also include locking means for a plug connector like a thread, a protrusion or bayonet components. This embodiment significantly simplifies manufacturing, as the spring loaded contact elements together with the base may be manufactured in one step while the outer housing may be manufactured separately. This would also allow using different materials for the spring loaded contact elements and for the outer housing.

In a further embodiment, to provide a high-quality low PIM electrical contact, means configured to position the plug connector in relationship to the socket connector may be provided. The plug connector may have a mechanical contact surface at a right angle to its center axis. The socket connector may have a corresponding mechanical contact surface, which also is at a right angle to the connector's center axis. The mechanical contact surfaces define a mechanical reference plane for each connector. When mated, both mechanical contact surfaces preferably are in close contact with each other. Therefore, the mechanical contact surfaces define the spatial relationship of the plug connector and the socket connector in the direction of the center axis, when the connectors are mated. This may allow for a precise positioning of the plug connector relative to the socket connector. Preferably, the mechanical contact surfaces are not part of the outer conductors' electrical contacts, as known from prior art. Instead, the mechanical contact surfaces may be separate surfaces, distant from the spring loaded contact elements.

The coaxial connectors furthermore may have precision centering means configured for aligning the center axis of the plug connector with the center axis of the socket connector. The precision centering means preferably are distant from the spring loaded contact elements. Preferably, the plug connector preferably has a cylindrical outer surface of the outer conductor, while the socket connector preferably has a cylindrical inner surface of the outer conductor. This may also be reversed, such that the plug connector preferably has a cylindrical inner surface of the outer conductor, while the socket connector preferably has a cylindrical outer surface of the outer conductor. Furthermore, the precision centering means may be distant from the mechanical contact surfaces defining the spatial relationship of the plug connector and the socket connector in the direction of the center axis. The cylindrical inner surface preferably fits tightly into the cylindrical outer surface and therefore limits parallel displacement of both center axes, so that the center axis of the plug connector is aligned with the center axis of the socket connector. Alternatively, the precision centering means may have a conical shape comprising a conical surface at the plug connector and at the socket connector. Furthermore, it is preferred, if the precision centering means and/or the mechanical contact surfaces are sized to prevent tilting of the plug connector against the socket connector.

Due to the precision positioning means the location of the plug connector with respect to the socket connector is laterally (radially) and axially within a comparatively low tolerance. When mated, the spring-loaded contact elements of the socket connector's outer conductor are in electrical contact with the outer conductor of the plug connector at a plug connector contact surface. Due to the high precision centering, the contact forces of all spring-loaded contact elements are equal. This results in an even current distribution and therefore high return loss and low passive intermodulation. Allowing for a simple and low pressure mating of the connectors, a conical section is provided at the plug connector's outer conductor, which continuously forces the spring-loaded contact elements to a smaller radius when mating the connector. Dependent on the slope of the conical section low insertion forces and high contact pressures may be obtained.

Herein the term of "one part" relates to a monolithic embodiment. Accordingly, the connector base, the outer conductor and optionally, the outer housing are made of one part. This means that they are machined in one piece, molded in one piece or manufactured otherwise in one piece such there exist no interconnections between the connector base, the outer conductor and optionally, the outer housing.

BRIEF DESCRIPTION OF THE DRAWINGS

In the following, the invention is described without limitation of the general inventive concept in reference to examples of embodiments and the drawings, of which.

Figure 1B:
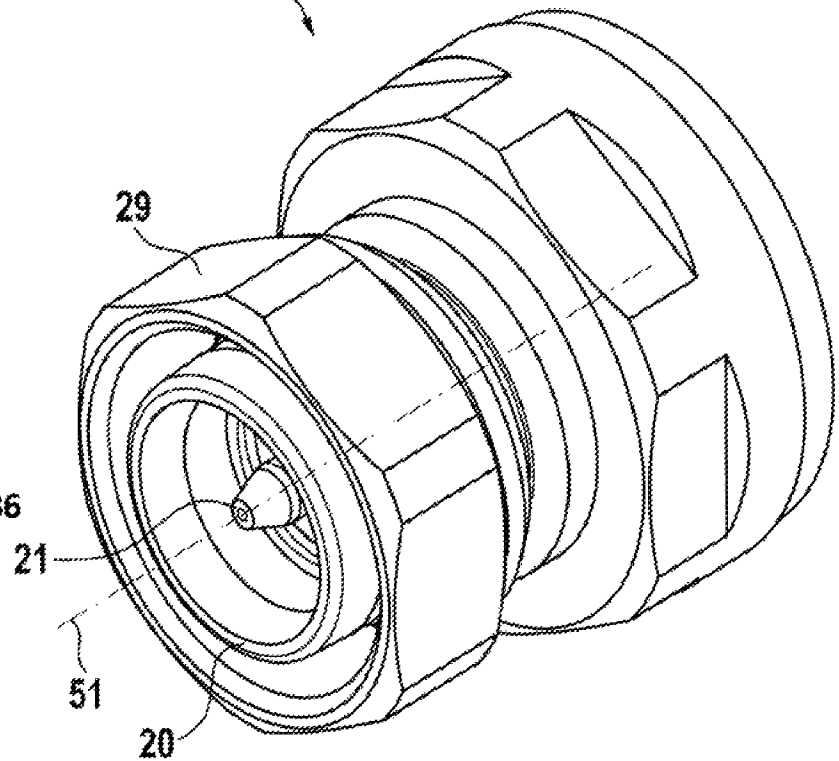
FIGS. 1A and 1B show a coaxial socket connector and a coaxial plug connector, respectively.

While embodiments of the invention can be modified and assume alternative forms, specific examples are shown in the drawings and are described in detail below. It should be understood, however, that the drawings and the corresponding detailed description are not intended to limit the invention to any particular disclosed forms, but to the contrary, the scope of the intention is intended to cover all modifications, equivalents, and alternatives as defined by the appended claims.

DETAILED DESCRIPTION

Figure 1A:
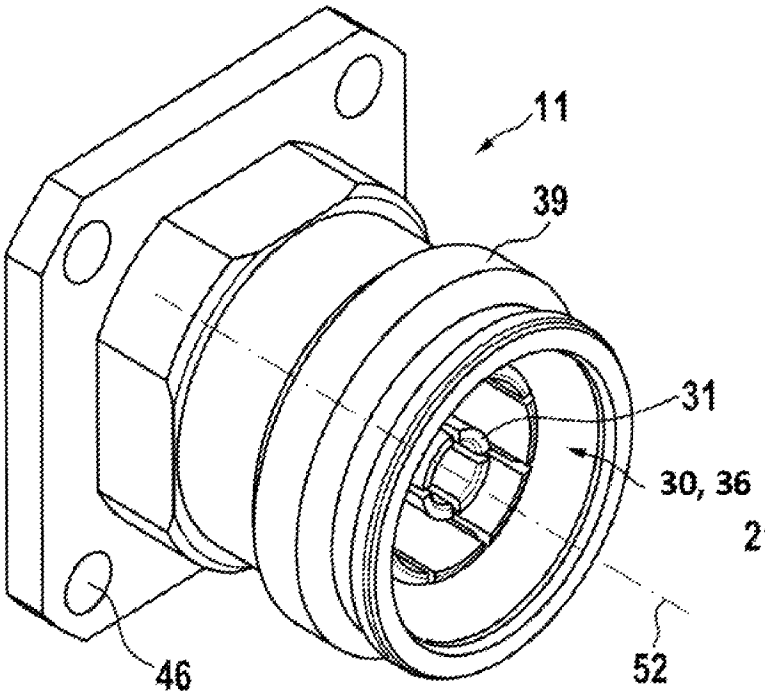

In FIGS. 1A, 1Ba coaxial plug connector 10 and a coaxial socket connector 11 are shown, respectively. The coaxial socket connector 11 includes at least one center conductor 31 and one outer conductor 30. The outer conductor 30 includes a plurality of slits 35 (with lands in between the neighboring slits), forming a plurality of spring-loaded contact elements 36 at its socket connector-facing end. A center axis 52 of the socket connector is defined by the center of center conductor 31.

The complementary coaxial plug connector 10 includes at least one center conductor 21 and one outer conductor 20. A center axis 51 of the plug connector is defined by the center of the center conductor 21. When the plug connector 10 is mated with the coaxial socket connector 11, the center axes 51, 52 coincide.

Preferably, at least one locking means 29, 39 is provided for locking or fastening the plug connector 10 to the socket connector 11. The at least one locking means 29 of the plug connector 10 interfaces is dimensioned to interface with the at least one locking means 39 of the socket connector 11. The locking means may be of a screw type such as, for example, a thread or bayonet type. The plug connector may have a nut 27 or a handle configured to rotate the locking means 29 and therefore initiate a locking action.

Figure 2B:
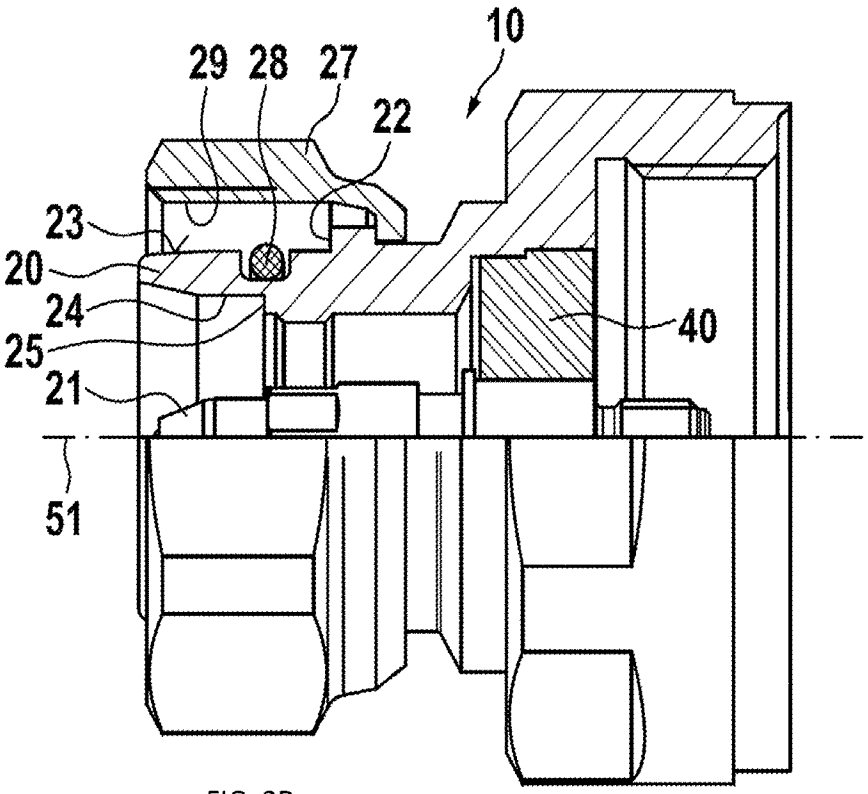
FIGS. 2A and 2B show the coaxial socket connector and the coaxial plug connector in partial sectional views.
Figure 2A:
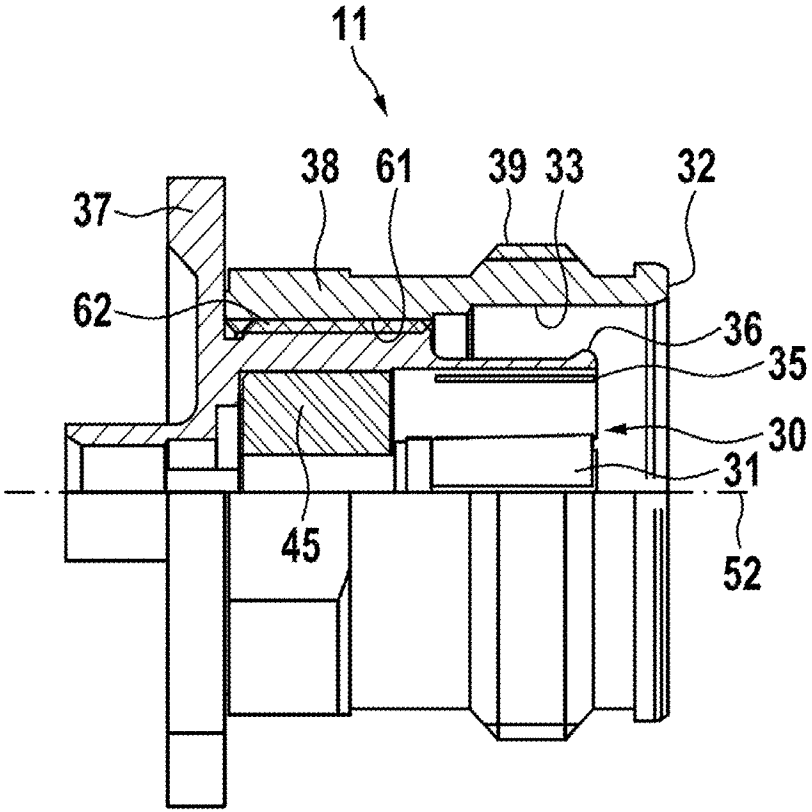

FIGS. 2A, 2B illustrate partial sectional views of the socket connector 11 and the plug connector 10 of FIGS. 1A and 1B, respectively. Here, the circular protrusion 25 and the O-ring 28 are made visible.77

According to a first embodiment, the socket connector 11 has a connector base 37 dimensioned to mount the connector. The base 37 may be mounted to any device such as a metal plate, a housing, or a similar object. Preferably, the base includes a flange, most preferably a rectangular flange. The flange may be held by at least one screw which may be arranged to pass through at least one hole 46. The base 37 may also have a cylindrical shape, and preferably have a thread so that the base may be held in a hole and locked by a nut. Preferably, the base 37 serves as a ground electrical contact.

The outer conductor 30 comprising a plurality of spring-loaded contact elements 36 is configured as one, integral, inseparable part with the base 37. Due to this monolithic configuration of the conductor 30 and the base 37, there is no electrical connection in the current path of the outer conductor between two parts of the outer conductor, which may have a thin oxide layer generating PIM. Therefore, PIM is minimized. A benefit of this embodiment is, that there are no additional mechanical tolerances conventionally required when fitting two separate parts such as the outer conductor and the base, as the one part may be made in one manufacturing step. This leads to a higher precision and lower position tolerances, specifically of the mechanical contact surface and the precision centering means, which further causes lower PIM.

In a related embodiment, the outer housing 38 of the coaxial socket connector is screwed, soldered or welded to the base 37. The outer housing 38 may have an inner housing thread 61 fitting to a base thread 62 at the base 37 and/or at the spring loaded contact elements 30 (that forms one integral part with the base 37). Preferably, the inner thread 61 is dimensionally adapted to fit to an outer thread 62 of the base 37. The outer housing 38 may further include a mechanical reference plane and/or centering means. It may also include locking means for a plug connector like a thread, a protrusion or bayonet components. This embodiment significantly simplifies manufacturing, as the spring-loaded contact elements 36 together with the base 37 may be manufactured in one step, while the outer housing may be manufactured separately. Such manufacturing separability also allows for using different materials for the spring-loaded contact elements 36 and for the outer housing 38. The increased mechanical precision, further leading to reduced PIM, provides additional operational advantage over the configurations known in related art. Due to the fact that the length of the outer housing 38 is larger than the thickness of the base 38, threads 61, 62 as well as corresponding soldering or welding surfaces may have a larger length as compared to the small base thickness into which the outer conductor 38 may have been press-fitted. The larger length further results in higher mechanical precision.

Preferably, the outer conductor 20 of the plug connector 10 is dimensioned to fit around the outer conductor 30 of the socket connector 11 and, therefore, has a larger diameter than that of the outer conductor 30. In an alternative embodiment, the outer conductor 20 of the plug connector 10 may be configured to fit within the outer conductor 30 of the socket connector 11 (and, therefore, have a diameter smaller than that of the outer conductor). Furthermore, the center conductor 21 of the plug connector 10 and the center conductor 31 of the socket connector 11 may be connected to one another. Preferably, the center conductor 31 of the socket connector 11 is a female connector, while the plug connector's 10 center conductor 21 is a male connector. Alternatively, the "gender" may be reversed. The center conductors 21, 31 are held within the outer conductors 20, 30 by means of insulators 40, 45.

In an embodiment, precision positioning of the plug connector 10 in relation to the socket connector 11 is achieved by observing at least the following:

Defining the positions of the plug connector 10 and the center axis 52 of the socket connector 11, along (in the direction of) the center axis 51, with a mechanical contact surface 22 of the plug connector and a mechanical contact surface 32 of the socket connector, which are in close contact when the connectors are mated. The contact plane defined by the mechanical contact surfaces is the mechanical reference plane of the connector.

Precisely centering (e.g. aligning the center axis 51 of the plug connector 10 and the center axis 52 of the socket connector 11) with the use of a plug connector's precision centering means 23, which is judiciously dimensioned to fit into a socket connector's precision centering means 33.

The plug connector's precision centering means 23 preferably has a cylindrically shaped precision-machined outer contour. The plug connector's precision centering means 23 preferably is part of the outer conductor 20, which configuration allows to keep mechanical tolerances low. (In a related embodiment, the precision centering means 23 may also be configured to be separate from the outer conductor 20; not shown. Furthermore, the socket connector's precision centering means 33 preferably has a cylindrically shaped precision-machined inner contour, tightly fitting around the plug connector's precision centering means 23 (when the two part are mated). This socket connector's precision centering 33 means may be part of the outer conductor 30, but may also be separate from the outer conductor 30, depending on the specifics of the practical implementation of the component 11. When the connectors 10, 11 are mated, the precision centering means 23, 33 align the center axis 51 of the plug connector and the center axis 52 of the socket connector.

For achieving a good electrical contact, the socket connector's outer conductor 30 has a plurality of slits 35 extending from the plug connector-facing end of the outer conductor 30 and forming a plurality of spring-loaded contact elements 36. When the components 10, 11 are mated, these spring-loaded contact elements 36 of the outer conductor 30 form electrically contact with the plug connector at a contact surface 24.

Figure 3:
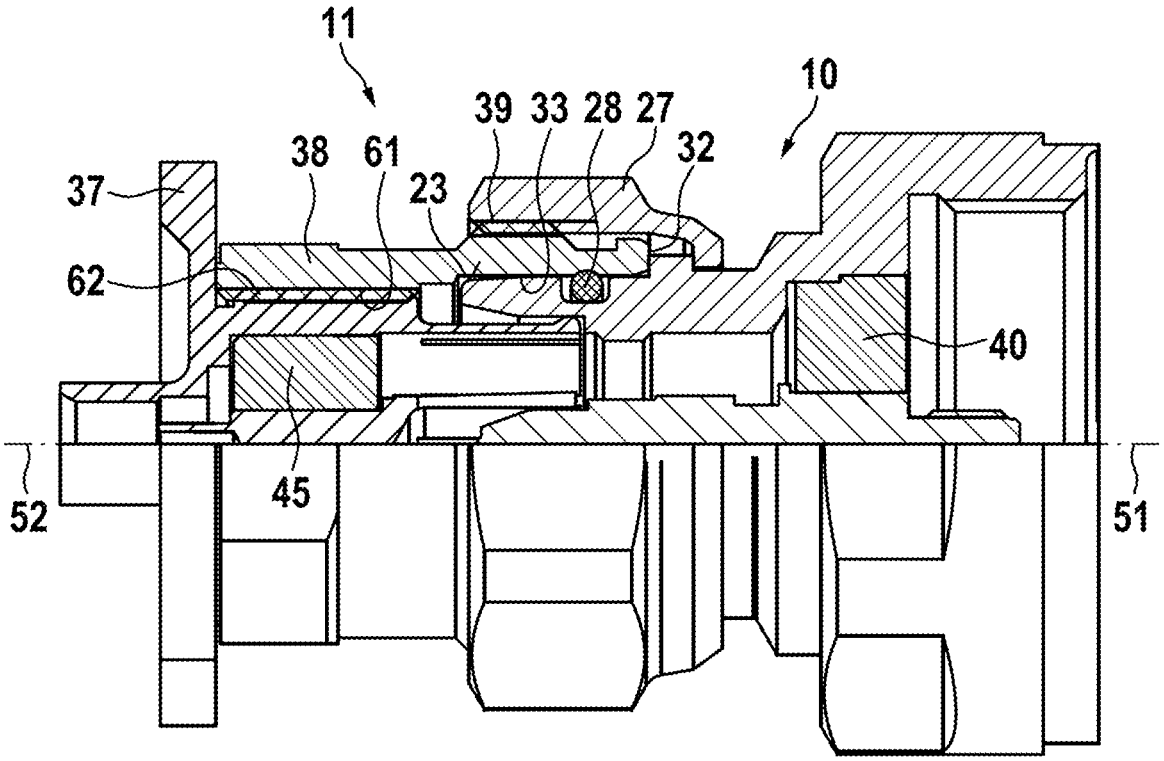
FIG. 3 presents a practical cross-sectional view of the socket connector and the plug connector mated with one another.

FIG. 3 shows both connectors 10, 11 mated together.

Figure 4:
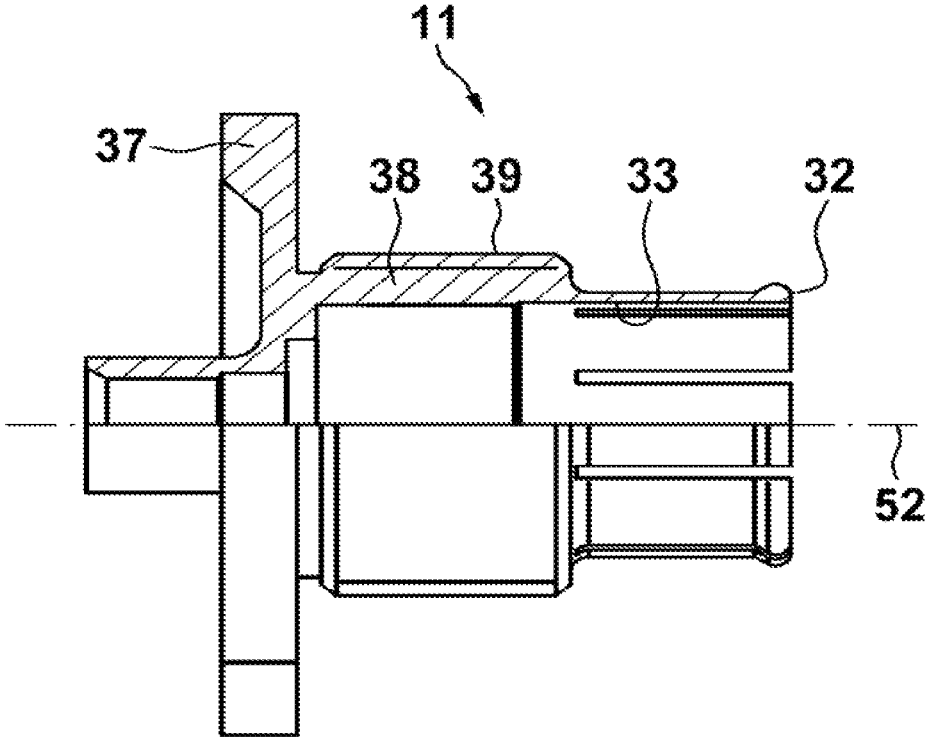
FIG. 4 illustrates details of the mated connectors.

FIG. 4 shows the base 37 with the socket connector's outer conductor 30 but without other components.

Figure 5:
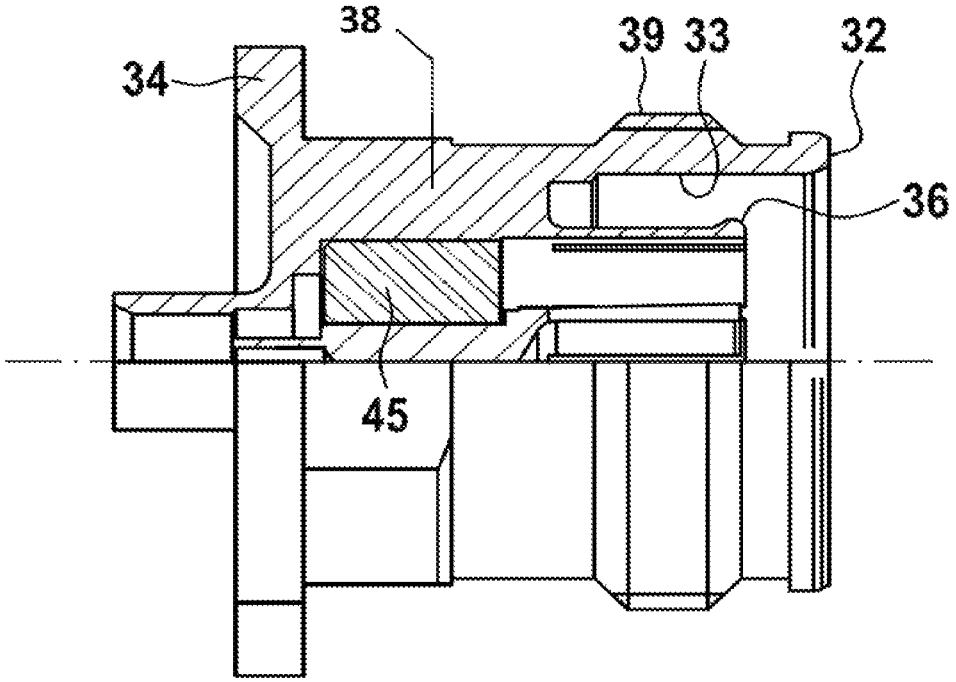
FIG. 5 presents additional details of the mated connectors.

FIG. 5 shows a related embodiment of the coaxial socket connector 11, in which the outer housing 38 of the coaxial socket connector 11 is also one part with the base 34. Therefore, the outer housing thread 61 and the base thread are no more required. This monolithic embodiment provides a very simple and mechanically-robust implementation of the invention.

The outer housing 38 may further include a mechanical reference plane and/or centering means. It may also include locking means 39 for a plug connector (such as a thread, a protrusion, or a bayonet component).

A practical benefit provided by this embodiment is that no additional mechanical tolerances are required as compared with the situation when two separate part (such as spatially separable outer conductor portions and the base portion) are being fitted together, as the one integral, whole, monolithic, stand-alone component may be fabricated in one manufacturing step. This configuration leads to a higher precision and lower position tolerances, specifically of the mechanical contact surface and the precision centering means, which further leads to lower PIM. As in this embodiment base 34 includes the outer conductor 30 and the outer housing 38, the total mechanical tolerances are the lowest thereby leading to the lowest PIM.

Figure 6:
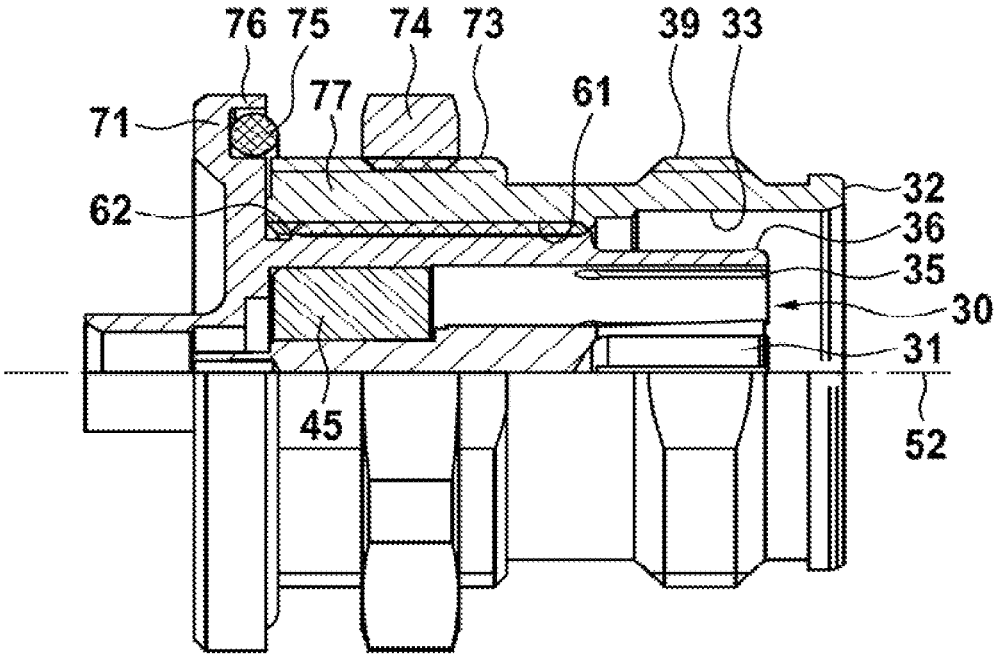
FIG. 6 shows a screw-in version of the connector.

FIG. 6 shows a screw-in embodiment of the RF connector of the invention. This embodiment is very similar to the ones discussed above, but it has no flange. Instead, the base 71 includes a bearing surface 76. The outer housing 77 includes an outer thread 73 dimensioned to hold a nut 74, which may be tightened to hold any device (such as, for example, a metal plate, a housing, or a similar component) between the bearing surface 76 and the nut 74. There may be a seal element 75 disposed close to the bearing surface 76.

Figure 7:
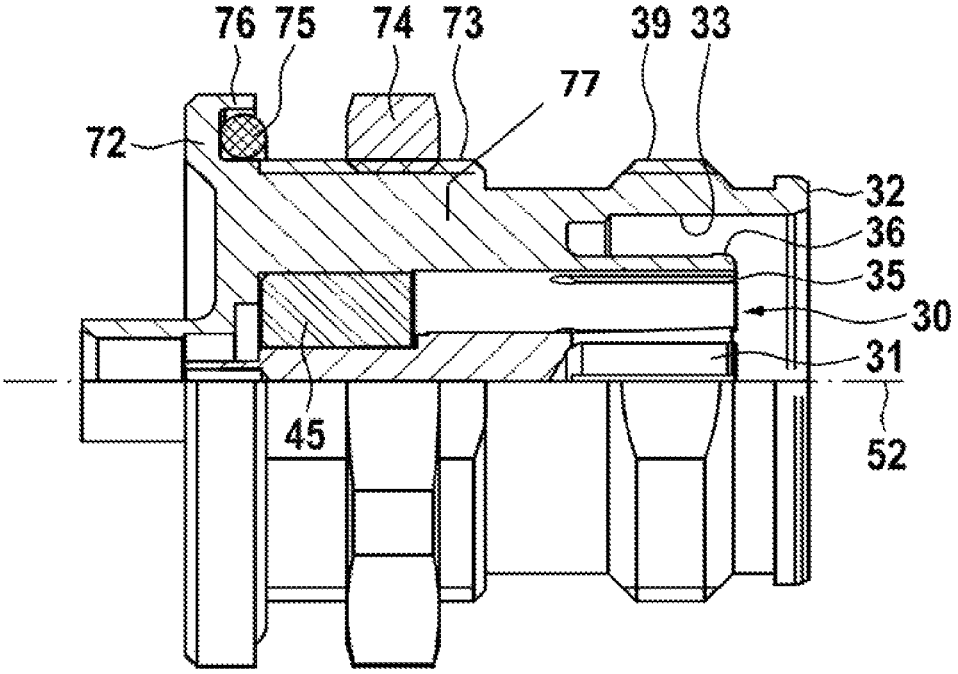
FIG. 7 shows a related screw-in version of the connector.

FIG. 7 illustrates yet another screw-in version of the RF connector. Here, the base 72 also forms one integral, monolithic, inseparable, stand-alone component with the outer housing 77.

It will be appreciated to those skilled in the art having the benefit of this disclosure that this invention is believed to provide RF connectors. Further modifications and alternative embodiments of various aspects of the invention will be apparent to those skilled in the art in view of this description. Accordingly, this description is to be construed as illustrative only and is provided for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

LIST OF REFERENCE NUMERALS

10 coaxial plug connector
11 coaxial socket connector
20 plug connector outer conductor
21 plug connector center conductor
22 plug connector mechanical contact surface
23 plug connector precision centering means
24 plug connector outer conductor contact area
25 circular protrusion
28 O-ring
29 locking means
30 socket connector outer conductor
31 socket connector center conductor
32 socket connector mechanical contact surface
33 socket connector precision centering means
34 connector base with outer housing
35 slits
36 spring loaded contact elements
37 connector base
38 outer housing
39 locking means
40 insulator
45 insulator
46 screw hole
51 center axis of the plug connector
52 center axis of the socket connector
61 thread of the outer housing
62 base thread/thread of the base
71 connector base
72 connector base with outer housing
73 mounting thread
74 nut
75 sealing element
76 bearing surface
77 outer housing

The invention claimed is:

1. A radio-frequency (RF) connector comprising:

a stand-alone socket female connector that includes:

a center conductor of the socket connector having a first center axis of the socket connector, an outer surface of the center conductor contacting air, an outer conductor of the socket connector coaxial with said center conductor, wherein the outer conductor of the socket connector is dimensioned to have a cylindrical shape with slits that form a plurality of spring-loaded contact elements of the outer conductor of the socket connector, an outer housing portion forming an integral part with the outer conductor, a base that is dimensioned to removably mount the stand-alone socket connector to an auxiliary component, wherein the base is defined by a generally flat flange and a cylindrical protrusion from the generally flat flange to mount the generally flat flange of the base directly to the auxiliary component, wherein said protrusion:

has an outer dimension smaller that an outer dimension of the flange;

is separated from the outer conductor by the flange;

extends along the first center axis; and terminates the base on a side opposite to the outer conductor;

wherein said spring-loaded contact elements of the outer conductor are not pressed forming a press fit, nor soldered, nor welded into the base.

2. The RF connector according to claim 1, wherein the outer housing and the base form an integral part and a front surface of the base that face the outer housing is either flat or contains an annular groove, formed circumferentially about the first center axis, and when the front surface is flat, the base includes openings therethrough configured to mount the stand-alone socket connector to the auxiliary component, and the outer housing includes a first outer thread disposed around the plurality of spring-loaded contact elements of the outer conductor, and when the front surface includes said annular groove, the groove has a radius that is greater than a radius of the outer housing with respect to the first center axis, and the outer housing comprises a second outer thread that is formed next to the front surface of the flange and that is separated from the first outer thread.

3. The RF connector according to claim 2, wherein, when the front surface include said annular groove, a portion of the front surface outside of the groove is configured as a bearing surface to be brought in contact with the auxiliary component to mount the stand-alone socket connector to the auxiliary component between the bearing surface and a nut threaded onto the second outer thread.

4. The RF connector according to claim 1, further comprising a plug connector that has an outer conductor of the plug connector and a second center axis, and dimensioned to be mechanically mated with the socket connector;

wherein the socket connector includes a mechanical contact surface at a right angle to the first center axis and distant from the spring-loaded contact elements to define a spatial relationship of the socket connector and the plug connector element in a direction of the first center axis of the socket connector, when the socket connector and the plug connector are mated with one another, and at least one precision centering means of the plug connector, said at least one precision means i) dimensioned to make the second center axis of the plug connector coincide with the first center axis of the socket connector when the socket connector and the plug connector are mated with one another.

5. The RF connector according to claim 4, wherein an outer conductor of the plug connector has a cylindrical outer contour thereof configured as at least one precision centering means of the plug connector and precision machined to geometrically match to at least one precision centering means of the socket connector.

6. The RF connector according to claim 4, wherein the socket connector has at least one precision centering means has a cylindrical inner contour which is precision machined to geometrically match to the at least one precision centering means of the plug connector.

* * * * *